US007935208B2

(12) United States Patent
Park et al.

(10) Patent No.: US 7,935,208 B2
(45) Date of Patent: May 3, 2011

(54) METHOD FOR MANUFACTURING A FIBER-REINFORCED COMPOSITE SABOT BY USING BAND/HOOP LAMINATION

(75) Inventors: In-Seo Park, Daejeon-si (KR); Jin-Seok Kim, Daejeon-si (KR); Seung-Un Yang, Changwon-si (KR); Young-Jun Jeon, Gimhae-si (KR)

(73) Assignee: Agency for Defense Development, Yuseong-gu, Daejeon-si (KR)

( * ) Notice: Subject to any disclaimer, the term of this patent is extended or adjusted under 35 U.S.C. 154(b) by 297 days.

(21) Appl. No.: 12/235,649

(22) Filed: Sep. 23, 2008

(65) Prior Publication Data

US 2009/0107355 A1 Apr. 30, 2009

(30) Foreign Application Priority Data

Oct. 31, 2007 (KR) ..... 10-2007-0109929

(51) Int. Cl.
*F42B 14/06* (2006.01)

(52) U.S. Cl. ..... 156/212; 156/304.1; 102/520

(58) Field of Classification Search ..... 102/501, 102/520–523; 156/172, 187, 189–195, 212–213
See application file for complete search history.

(56) References Cited

U.S. PATENT DOCUMENTS

| | | | | |
|---|---|---|---|---|
| 4,372,217 | A * | 2/1983 | Kirkendall et al. | 102/521 |
| 4,735,148 | A | 4/1988 | Holtzman | |
| 4,953,466 | A * | 9/1990 | von Gerlach | 102/521 |
| 4,958,571 | A | 9/1990 | Puckett | |
| 5,635,660 | A | 6/1997 | McGovern | |
| 5,640,054 | A | 6/1997 | McGovern | |
| 5,789,699 | A | 8/1998 | Stewart | |
| 6,125,764 | A | 10/2000 | Kamdar | |
| 6,186,094 | B1 | 2/2001 | Kamdar | |
| 6,241,506 | B1 | 6/2001 | Kassuelke | |
| 6,279,214 | B1 | 8/2001 | Kassuelke | |
| 7,013,811 | B1 | 3/2006 | Sebasto | |
| 7,594,472 | B1 * | 9/2009 | Parratt et al. | 102/520 |

FOREIGN PATENT DOCUMENTS

| | | |
|---|---|---|
| EP | 0982561 | 3/2000 |
| EP | 0989382 | 3/2000 |

* cited by examiner

*Primary Examiner* — Sam C Yao

(74) *Attorney, Agent, or Firm* — Cahn & Samuels, LLP

(57) ABSTRACT

Disclosed is a method for manufacturing a fiber-reinforced composite sabot for use in APFSDS (Armor Piercing Fin Stabilized Discarding Sabot), wherein both Band lamination and Hoop lamination are used in manufacturing a polymer based FRP(Fiber Reinforced Plastic) for use in the sabot in order to prevent the prepreg delamination in the circumferential direction caused by the radial lamination. The method for manufacturing a fiber-reinforced composite sabot of the present invention comprises the steps of a sub-segment forming step, a piece forming step and a sabot forming step, and the lamination is carried out with improved segment lamination form preventing the damage in the 120 degree surface in the process of treating the sabot.

6 Claims, 10 Drawing Sheets

METHOD FOR MANUFACTURING A FIBER-REINFORCED COMPOSITE SABOT BY USING BAND/HOOP LAMINATION

CROSS-REFERENCE TO RELATED APPLICATIONS

This application claims priority to Republic of Korea application number 10-2007-0109929, filed on Oct. 31, 2007, which is hereby incorporated by reference in its entirety.

TECHNICAL FIELD

The present invention relates to a method for manufacturing a composite sabot, and more specifically, to a method for manufacturing a fiber-reinforced composite sabot for use in APFSDS (Armor Piercing Fin Stabilized Discarding Sabot) which is required to endure high pressure, wherein both Band lamination and Hoop lamination are used in manufacturing a polymer based FRP (Fiber Reinforced Plastic) for use in the sabot in order to prevent the prepreg delamination in the circumferential direction caused by the radial lamination.

PRIOR ARTS

Aluminum alloy is generally used for manufacturing the sabot for the APFSDS which is used for antitank guns. However, by using high-strength fabric-reinforced composite material having lower density than the aluminum for the sabot, the speed of the shell can be increased with the same energy thereby enhancing the power of the shell. Therefore wide range of research has been made in the field to manufacture lighter and more powerful sabot by replacing the metal sabot with the sabot made from polymer based fiber-reinforced material having specific strength.

The sabot is combined to the outer surface of the penetrator with three separable pieces and guides the sabot in the gun barrel, delivers the propulsive force to the penetrator, and is separated from the penetrator after the penetrator is propelled from the barrel, playing the role of structurally supporting the sabot and preventing leakage of pressure in the barrel. Therefore the weight of the sabot is very important in improving the performance of the whole system, and by making the sabot as light as possible, more propulsive force is delivered to the penetrator. Also, in order to deliver the propulsive force to the penetrator more efficiently, on the inner portion of the sabot is formed a concave-convex combining surface in the form of spiral or groove on the contacting surface with the penetrator. The outer portion of the sabot is formed so that the sabot closely contacts the barrel thereby sealing the barrel so that the pressure for the propulsive force is maintained. After the penetrator is separated from the barrel, the sabot is separated from the penetrator by friction with the air without affecting the propulsion of the penetrator.

FIG. 8 shows the cross section of the conventional aluminum sabot which shows that the sabot 3 is composed of three pieces and combined with the penetrator 2 of the APFSDS in the barrel 1 of the tank or armored vehicle.

Between the outer portion of the penetrator 2 and the inner portion of the corresponding sabot 3, is formed a concave-convex combining part 2*a*, 3*a* in the form of spiral or groove, and this concave-convex combining part 2*a*, 3*a* is formed not to be damaged considering the shearing stress from the propulsion force. The sabot produced by the conventional method is made from aluminum, and although presents no problem in endurance considering the shearing stress required at the time of propulsion, relatively high weight compared to the composite sabot causes problem in important properties of the penetrator such as aviation velocity, penetration strength on the target and other overall properties of the system.

Also, it is known that lamination in the radial direction has been adopted since the conventional lamination method in the axial or circumferential direction cannot obtain the required mechanical strength of the groove. Lamination in the radial direction uses prepreg made of unidirectional fiber or fabric fiber/resin, and the prepreg ply is laminated in perpendicular direction on the groove surface contacting the penetrator thus providing much improved shear strength compared to the above mentioned conventional lamination method in the axial or circumferential direction. However, while the required strength in the same or perpendicular direction of the surface contacting the penetrator is obtained in the radial direction lamination method, there is a problem of low adhesive strength in the direction in which the prepreg ply is laminated, and so there has been need for developing technology that can improve this strength.

Until recently, the patent applications relating radial directional lamination has been directed to the lamination technology or orientation of the fiber, for example U.S. Pat. No. 5,640,054 (Sabot segment molding apparatus and method for molding a sabot segment), and U.S. Pat. No. 5,789,699 (Composite ply architecture for sabot) and U.S. Pat. No. 6,125,764 (Simplified tailored composite architecture). The method of using high strength resin can be considered in order to reinforce the material property in the laminating direction, but the cost will be increased due to the high price of the material and complex manufacturing method.

The conventional composite sabots manufactured by the radial or circumferential laminating method also generated the delamination phenomenon from the severe bending of fiber.

OBJECTIVE OF THE INVENTION

The present invention has been designed to solve the above mentioned problems of prior arts, by using the Band/Hoop lamination on the outer lamination layer in the radial direction in order to prevent the prepreg delamination phenomenon and to provide an endurance from the circumferential high expansion forces.

Also the method of the present invention improved the form of lamination in segment lamination preventing the delamination problem stemming from the distortion of the fiber and also preventing the damage of the 120 degree surface when treating the sabot in manufacturing.

DISCLOSURE OF THE INVENTION

To solve the above problems of the prior arts, the present invention provides a method for manufacturing a fiber-reinforced composite sabot by laminating the prepreg fiber in the radial direction comprising a sub-segment forming step wherein four or more of sub-segments are formed with predetermined form by superposing a plurality of plies, a segment forming step wherein three or more of segments are formed by laminating said sub-segments, a piece forming step wherein three pieces are formed by laminating the segments, and a sabot forming step wherein a sabot is formed by combining the three pieces, the piece forming step further comprising a reinforcing step wherein two or more plies are superposed and the bands are continuously laminated on two or more surfaces of arc surface and both the 120 degree surfaces.

It is preferable that the reinforcing step further comprises, along with the step of laminating bands, a step of superposing two or more of plies and continuously laminating hoop on the arc surface of each piece.

Also it is preferable that a sub-segment forming step further comprises forming preliminary laminated board by superposing a plurality of plies.

Also it is preferable that the reinforcing step include further laminating the first sub-segment on the 120 degree surface.

Finally, the prepreg fiber material laminated in the radial direction is favorably one or more of fiber chosen from the group consisting of carbon fiber, graphite fiber and glass fiber, and the fiber prepreg fiber material is thermosetting or thermoplastic resin.

INDUSTRIAL EFFECT

According to the method for manufacturing a fiber-reinforced composite sabot by band/hoop lamination method of the present invention, the weight of the sabot can be reduced by 30% compared to the conventional aluminum sabot. Also, the band layer protects the sabot from the expansion pressure resulting from the high impact energy inside the barrel, and the hoop layer delivers the propulsion pressure 150 to the sabot uniformly thus protecting the sabot in the outermost surface and providing optimal design requirement that can endure the destructing force of the sabot.

BRIEF DESCRIPTION OF DRAWINGS

FIG. 5(*b*) is a cross sectional view showing laminated sub-segment.

FIG. 5(*c*) is a perspective view of a segment composing a piece.

FIG. 6(*b*) is a cross sectional view showing the piece composing a sabot.

FIG. 6(*c*) is a perspective view showing the piece composing a sabot.

DESCRIPTION ON THE NUMERAL OF THE DRAWINGS

Figure 1:
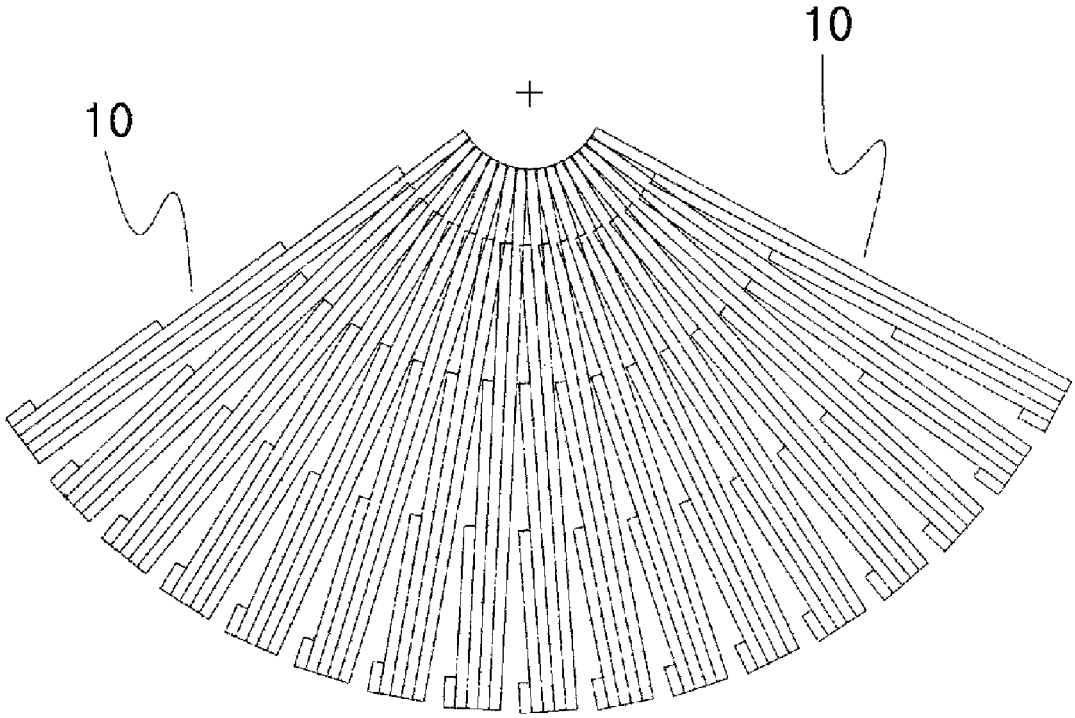
FIG. 1 shows the cross section of the piece laminated in the radial direction.

10: 120 degree surface
20: arc surface
30: basic plate
40: release plate
50: carbon fiber prepreg ply
60: preliminary laminating plate
70: sub-segment
71: first sub-segment
80: segment
90: band
100: hoop
110: outermost spare processing layer
120: propulsive pressure part in the barrel(rear part)
130: guiding line in laminating in the composite sabot
140: piece
150: distribution of propulsive force in the barrel
160: fiber reinforced composite sabot

BEST MODE

Example of the present invention will be described with reference to the drawings attached.

Figure 2:
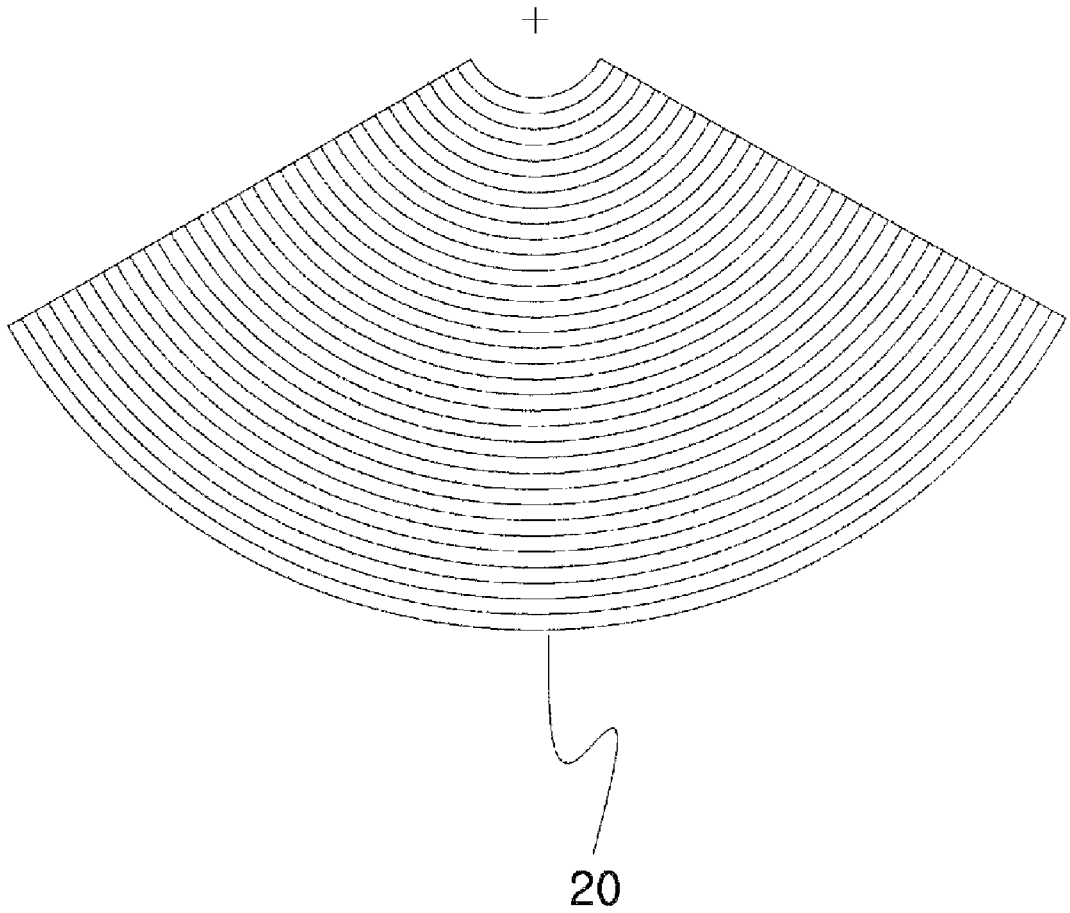
FIG. 2 shows the cross section of the piece laminated in the circumferential direction.

FIG. 1 shows the cross section of the piece laminated in the radial direction and FIG. 2 shows the cross section of the conventional piece laminated in the circumferential direction. In the pieces shown in FIG. 1 and FIG. 2, both 120 degree surface 10 and arc surface 20 exist although only 120 degree surface 10 is shown in FIG. 1 and arc surface 20 in FIG. 2.

Figure 3:
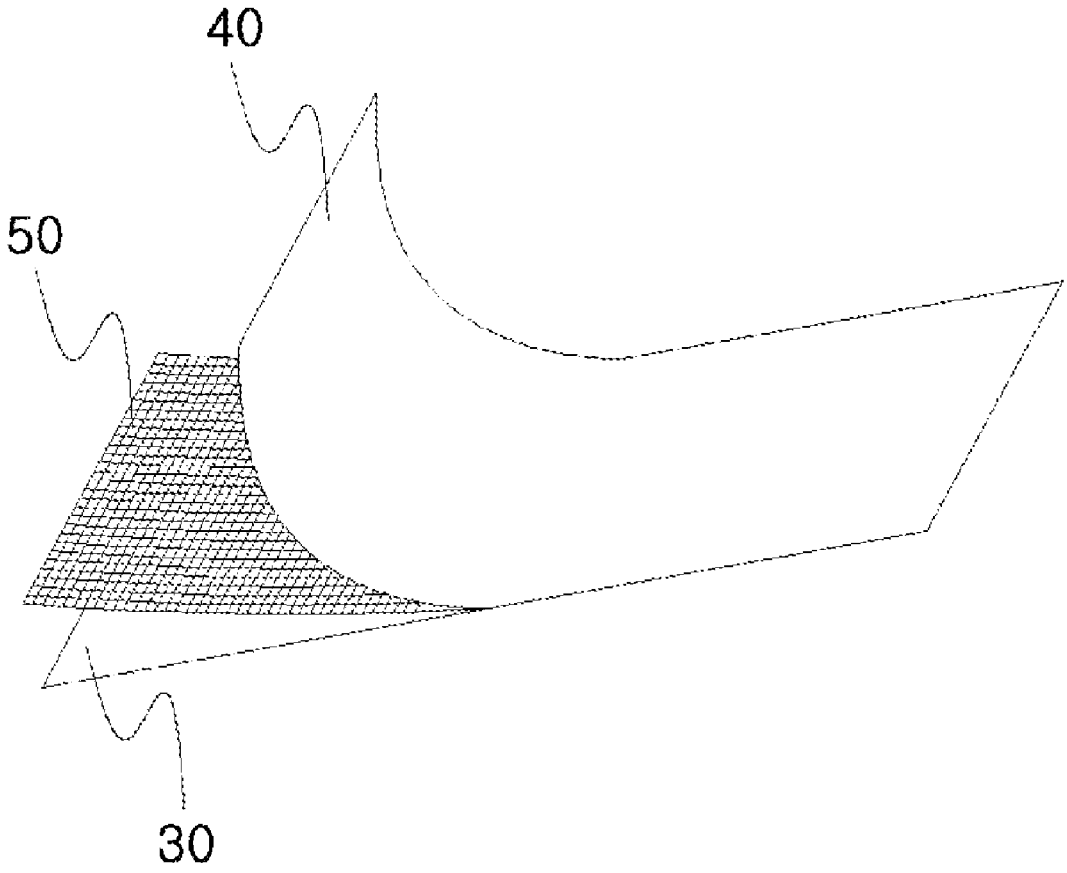
FIG. 3 is a perspective view of carbon fiber prepreg ply.

In the perspective view of FIG. 3, fiber prepreg ply 50 is illustrated along with basic plate 30 and release plate 40. The material of the fiber prepreg ply 50 is thermosetting or thermoplastic resin and one or more of fiber chosen from the group consisting of carbon fiber, graphite fiber or glass fiber is used as a fiber. By separating the basic plate 30 and release plate 40 from the produced fiber prepreg ply 50 and by laminating two or more of plies 50, a plurality of plies are closely attached as one set of flies due to the adhesive property of each ply.

Figure 4:
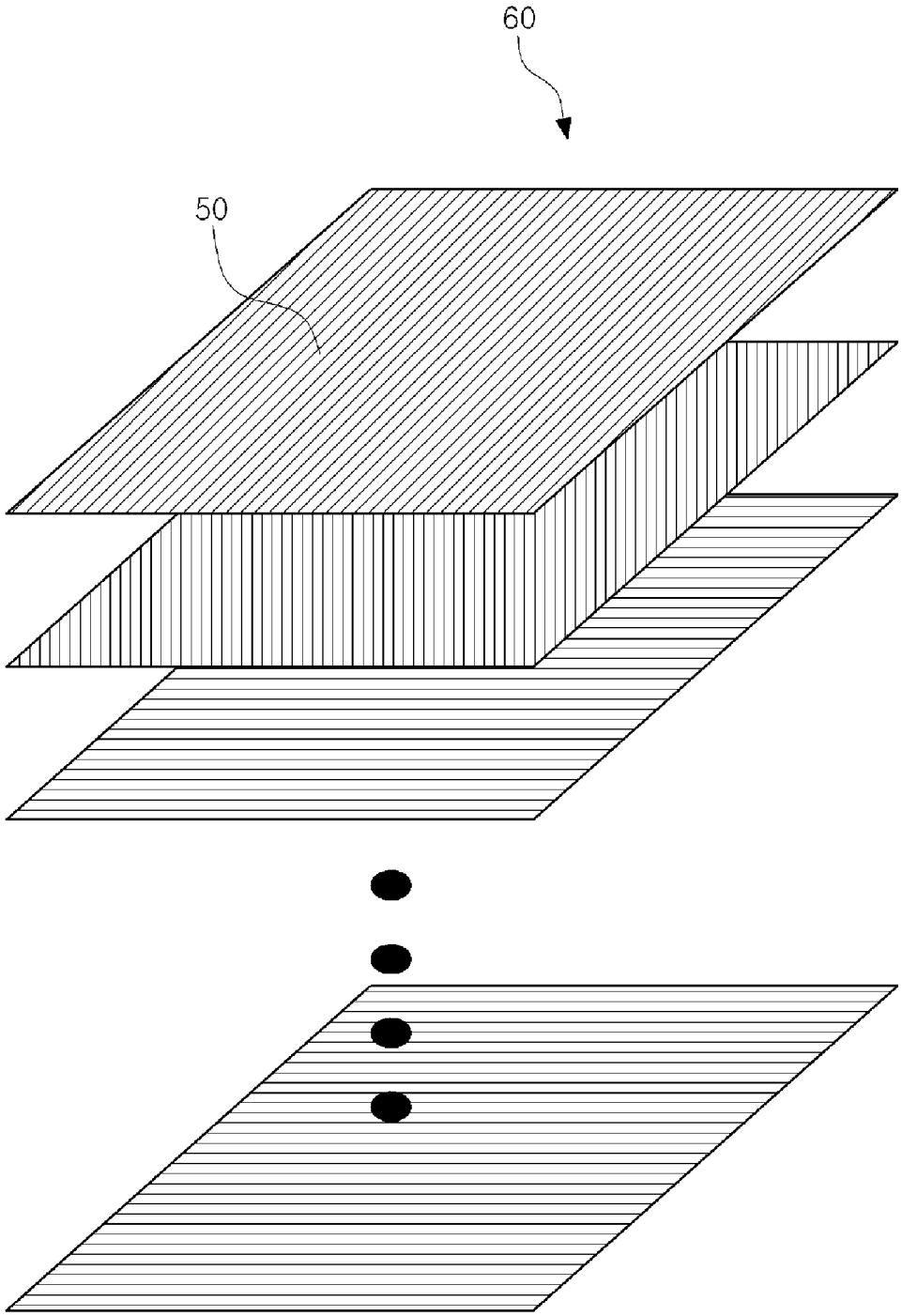
FIG. 4 is a perspective view showing a plurality of plies composing a preliminary lamination plate.
Figure 5A:
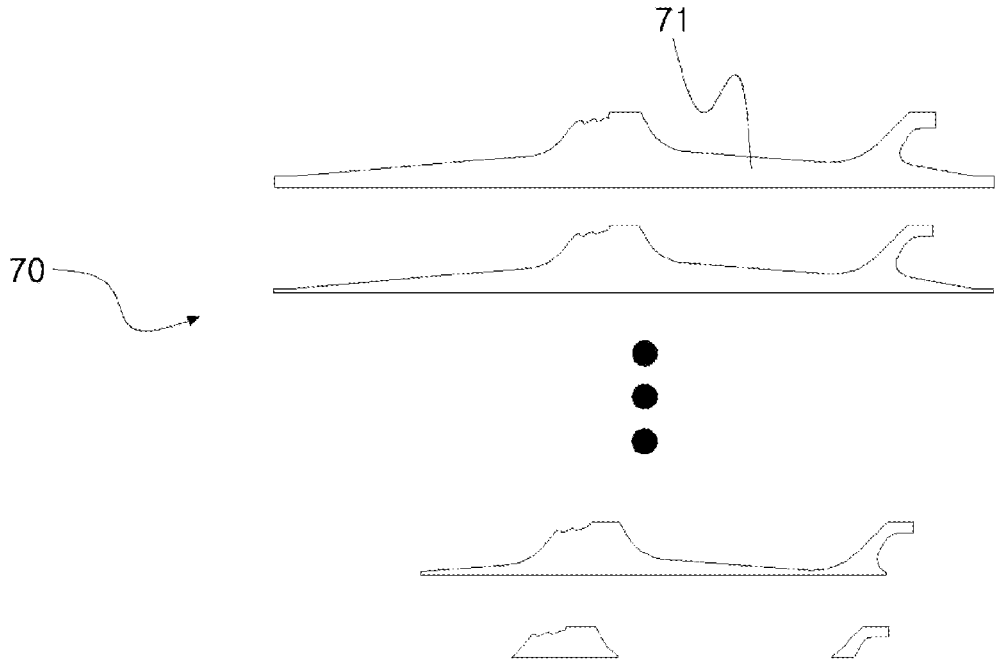
FIG. 5(*a*) shows the configuration of the sub-segment composing a segment.
Figure 5B:
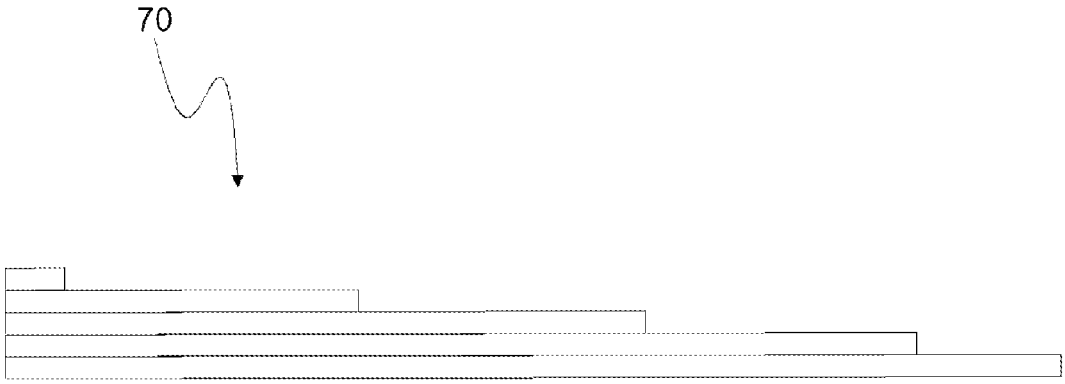
Figure 5C:
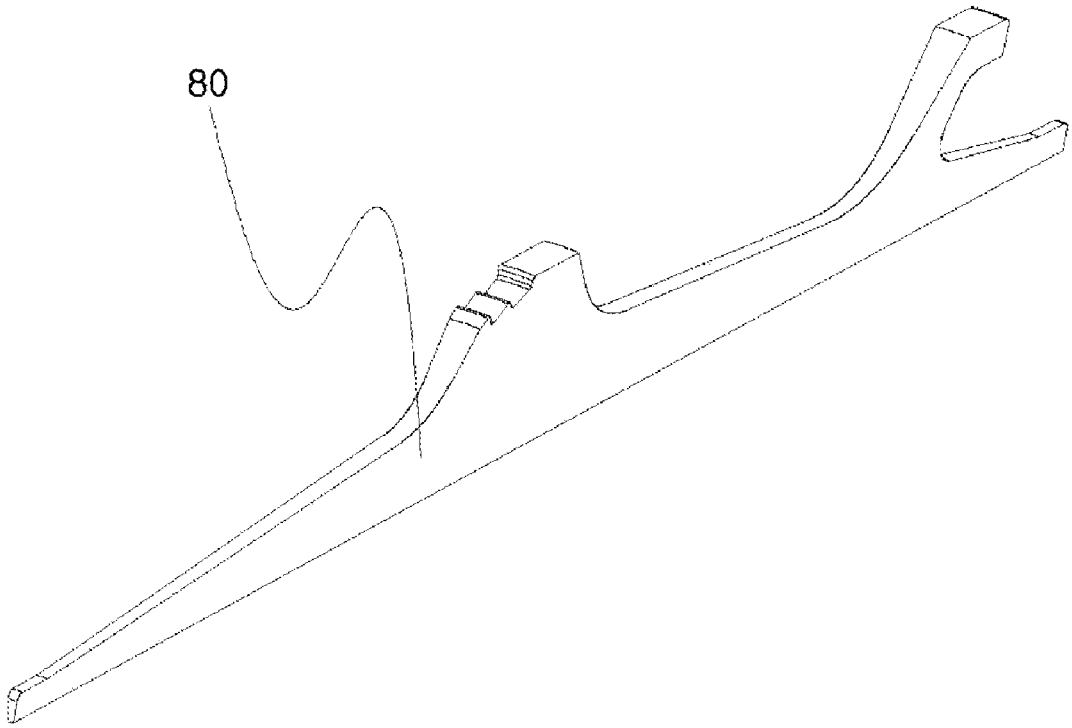

The laminated plies can be used to form a sub-segment with predetermined form, or, more preferably, can be used to form a preliminary laminating plate 60 by superposing a plurality of plies as shown in FIG. 4. The laminated plies can be used to form a variety form of sub-segment 80 by cutting the preliminary laminating plate 60 through a cutter as shown in FIGS. 5*a*-5*c*.

FIG. 5(*b*) is a cross sectional view showing laminated sub-segment 70. The segment 80, in the form as shown in FIG. 5(*b*), is formed by laminating a continuous form of sub-segment 70, except for the reinforcing sub-segment 71 of FIG. 5(*a*). The piece 140 is composed of segment 80 (as shown in FIGS. 5(*c*) and 6(*a*)) and has a longitudinal cross section in the form of fan-shaped form. A guiding line 130 passes through the center in the sabot 160 of FIG. 7. Therefore, three or more segments 80 are formed by laminating the sub-segments 70, which are cut in a variety form (as shown in FIG. 5(*a*)) according to the guide line 130. A plurality of segments are laminated to form a piece 140 having a 120 degree surface.

At this step of radial directional lamination, band 90 is laminated on both 120 degree surfaces 10 and outer surface of arc surface 20 in order to prevent delamination of radial lamination due to the high expansion pressure at the time of firing. In this case, even when the band 90 is laminated on only one of the two 120 degree surfaces and arc surface 20 of each piece 140, the combining surface (120 degree surface) of the piece 140 and outer circumferential surface (arc surface) are all formed in the form reinforced by band 90 when three pieces 140 are combined since three pieces 140 are combined to form a sabot 160.

It is preferable to laminate hoop 100 on the arc surface 20 of the piece 140 to obtain further mechanical strength required in the sabot, since the fiber, as well as the band 90 and resin, can also absorb the expansion force at the time of firing. It is preferable to use the same material and same adhesive in reinforced radial directional lamination and band/hoop lamination. By using this uniform co-curing manufacturing method, delamination between radial directional lamination and band/hoop lamination resulting from the difference between different expansion coefficients of the material can be prevented. Also, in the rear part 120 which receives the most strong propulsion energy in the barrel at the time of firing, it is preferable to form a relatively thicker band/hoop lamination layer in order to secure stable separation of the composite sabot as well as for the prevention of delamination between layers of the radial lamination.

Also, there could be a delamination phenomenon stemming from the distortion of the fiber in radial direction lamination causing damage to 120 degree surface which has been laminated to reinforce the layer. To improve this phenomenon, the reinforcing sub-segment 71 of FIG. 5(*a*) is laminated on both 120 degree surface of the piece 140 so that the distortion of the fiber is lessened and damage of the radial directional lamination from the process can be prevented.

Figure 6A:
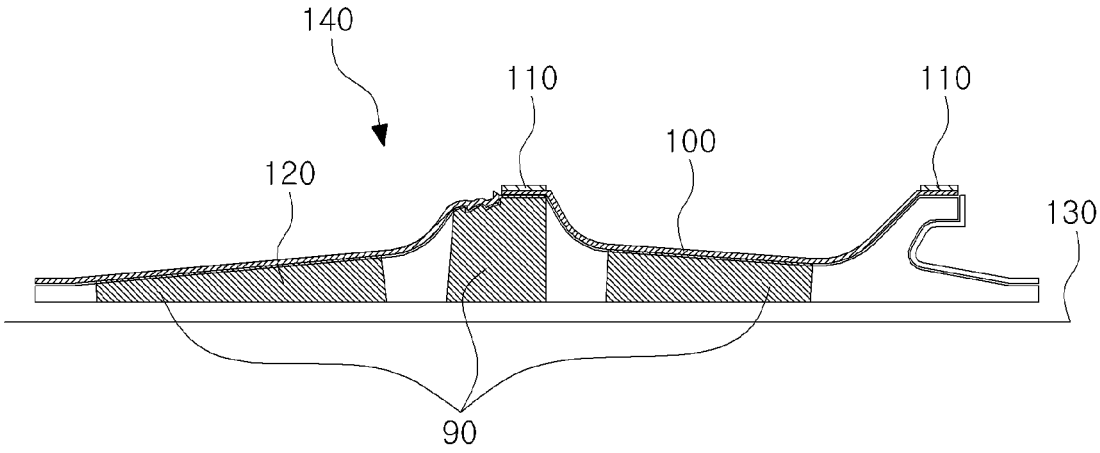
FIG. 6(*a*) is an enlarged view of the side of the piece composing a sabot.
Figure 6B:
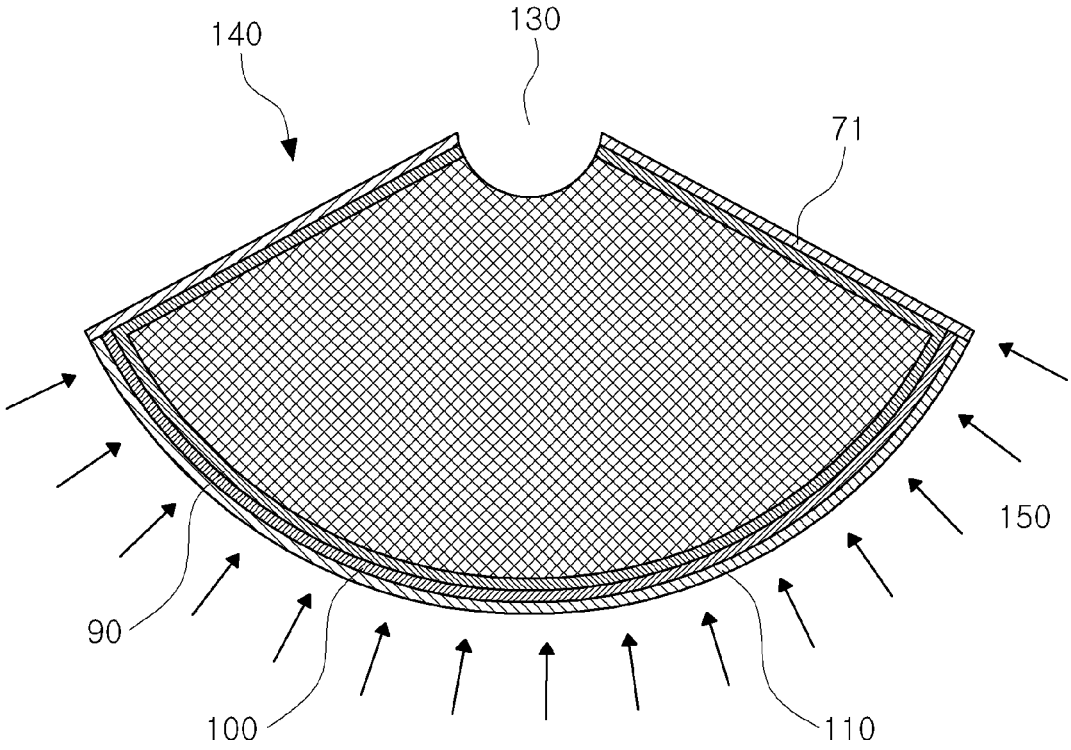
Figure 6C:
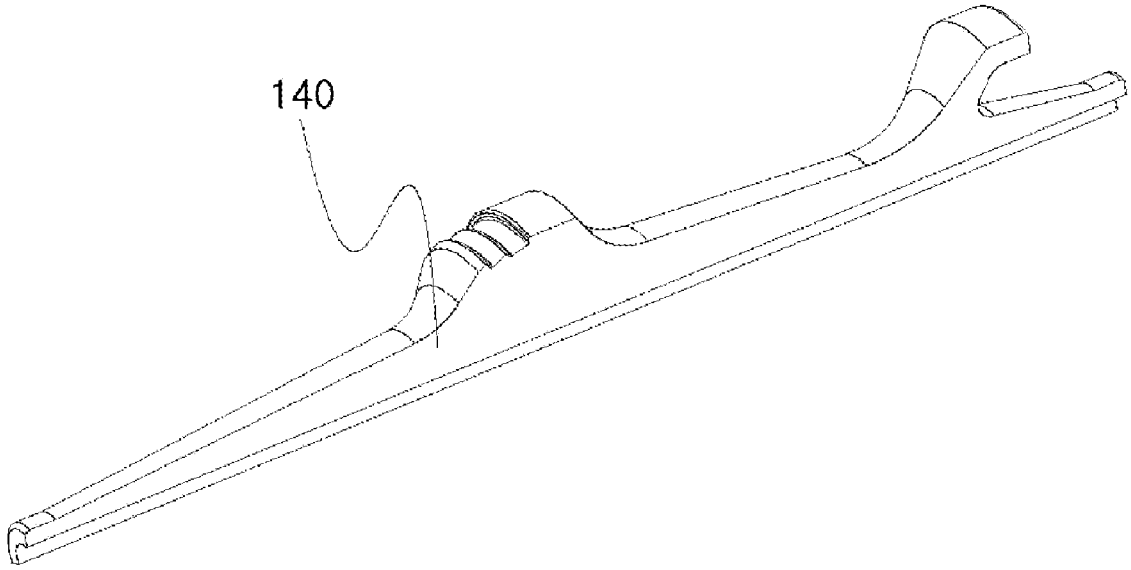

In addition, spare processing layer 110 is laminated on the outermost layer of the arc surface of the piece 140 in order to prevent the loss of the design adopted in processing the outermost layer considering spare space in the processing. As shown in FIG. 6(*a*) and FIG. 6(*b*), band 90 and reinforcing sub-segment 71 are laminated in that order on both 120 degree surfaces 10 of the piece 140, and band 90, hoop 100 and spare processing layer 110 are laminated in that order on the arc surface 20 of the piece. FIG. 6(*c*) illustrates the appearance of the reinforced piece 140.

Figure 7:
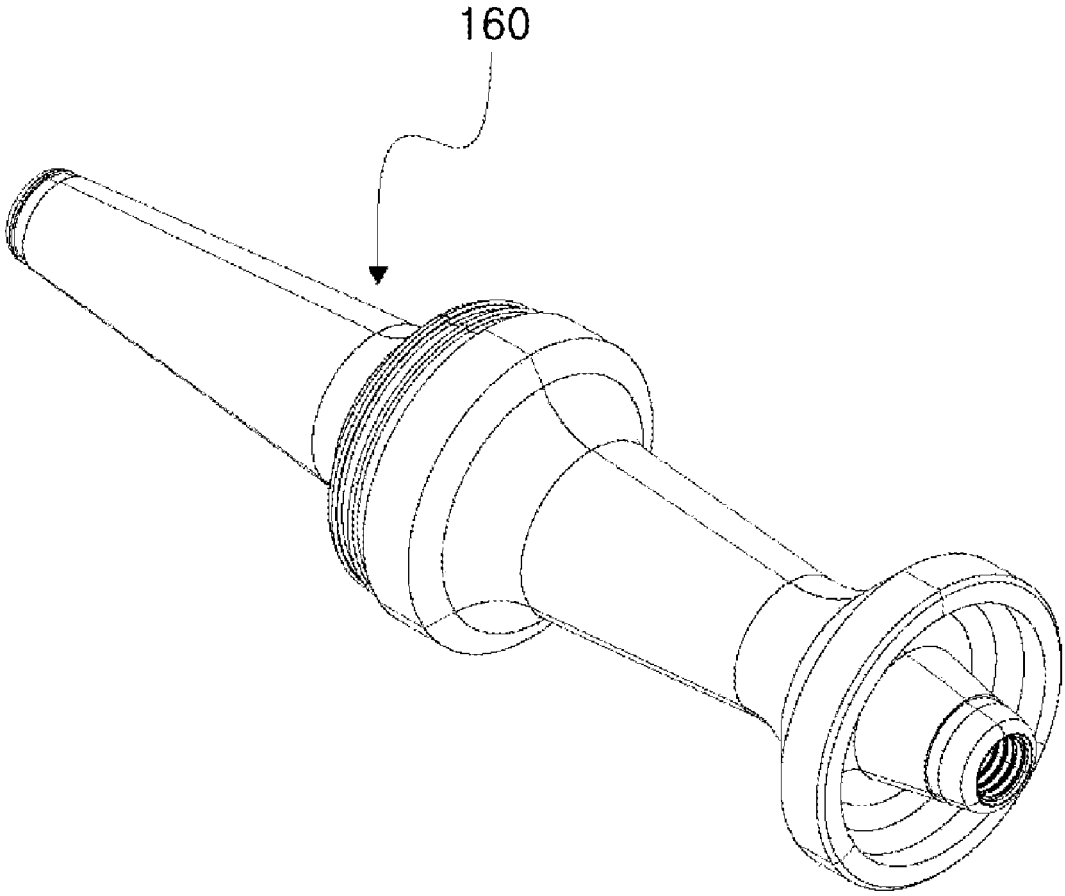
FIG. 7 is a perspective view showing the appearance of the sabot.
Figure 8:
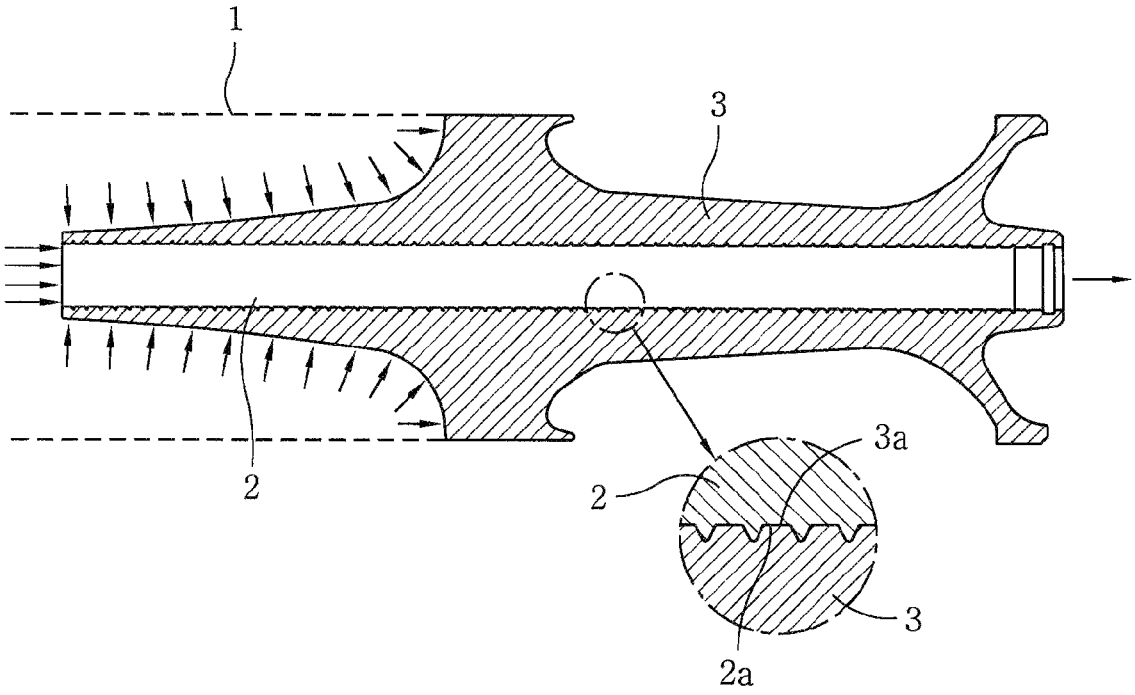
FIG. 8 is a longitudinal cross sectional view of conventional sabot configuration.

Lastly, the pieces 140 prepared by the above method is inserted into press mold to form fiber reinforced composite sabot 160 as shown in FIG. 7 and the forming process is carried out to closer and firmer forming by choosing appropriate pressure and temperature in the molding.

In forming the preliminary laminating plate by laminating the fiber prepreg ply as described above, forming sub-segment by cutting the preliminary laminating plate, forming a segment by laminating sub-segment and forming the piece by laminating the segment, the required mechanical strength of the sabot can be obtained by using the reinforcement method of band/hoop lamination of the present invention. Also, along with the method of band/hoop lamination of the present invention, the orientation method disclosed by the same applicant in Korean laid open patent application 2004-0024333, 2004-0024334 can be considered in the method of reinforced manufacturing method to obtain desirable mechanical strength of the sabot.

Although the preferable example of the present invention has been described above, it should be understood not to limit the scope of the present invention and any modification can be possible to those skilled in the art within the scope of the claims.

What is claimed is:

1. A method for manufacturing a fiber-reinforced composite sabot by laminating a prepreg fiber in the radial direction comprising:

a sub-segment forming step wherein four or more of sub-segments are formed with predetermined form by superposing a pluraity of plies;

a segment forming step wherein three or more of segments are formed by laminating the sub-segments;

a piece forming step wherein three pieces are formed by laminating the three or more of segments, each of the three pieces including an arc surface and two 120 degree surfaces;

a sabot forming step wherein a sabot is formed by combining the three pieces;

the piece forming step further comprising a reinforcing step wherein two or more plies are superposed and reinforcing bands are continuously laminated on two or more surfaces of the arc surface and surface and the two 120 degree surfaces;

the reinforcing step further comprises a step wherein hoops formed with superposed two or more piles are continuously laminated on the arc surface of each piece; and a spare processing layer is laminated on the outermost layer of the arc surface of the piece.

2. The method for manufacturing a fiber-reinforced composite sabot of claim 1 wherein the sub-segment forming step further comprises a step of forming preliminary laminating board by superposing a plurality of plies.

3. The method for manufacturing a fiber-reinforced composite sabot of claim 2 wherein the reinforcing step includes further laminating the reinforcing sub-segment on the 120 degree surface.

4. The method for manufacturing a fiber-reinforced composite sabot of claim 1 wherein the prepreg fiber laminated in the radial direction is one or more of fiber chosen from the group consisting of carbon fiber, graphite fiber and glass fiber, and material of the prepreg fiber is thermosetting or thermoplastic resin.

5. The method for manufacturing a fiber-reinforced composite sabot of claim 2 wherein the prepreg fiber laminated in the radial direction is one or more of fiber chosen from the group consisting of carbon fiber, graphite fiber and glass fiber, and material of the prepreg fiber is thermosetting or thermoplastic resin.

6. The method for manufacturing a fiber-reinforced composite sabot of claim 3 wherein the prepreg fiber laminated in the radial direction is one or more of fiber chosen from the group consisting of carbon fiber, graphite fiber and glass fiber, and material of the prepreg fiber is thermosetting or thermoplastic resin.

* * * * *